US009585215B2

(12) United States Patent
Kim

(10) Patent No.: US 9,585,215 B2
(45) Date of Patent: Feb. 28, 2017

(54) LIGHTING APPARATUS

(71) Applicant: SILICON WORKS CO., LTD., Daejeon-si (KR)

(72) Inventor: Yong Geun Kim, Suwon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 0 days.

(21) Appl. No.: 14/945,700

(22) Filed: Nov. 19, 2015

(65) Prior Publication Data

US 2016/0150605 A1 May 26, 2016

(30) Foreign Application Priority Data

Nov. 20, 2014 (KR) ..... 10-2014-0162498

(51) Int. Cl.
*H05B 33/08* (2006.01)

(52) U.S. Cl.
CPC ..... *H05B 33/083* (2013.01)

(58) Field of Classification Search
CPC .... H05B 37/02; H05B 41/24; H05B 33/0809; H05B 33/0818; H05B 33/083; H05B 33/0812; H05B 33/0827; H01L 2924/12041
USPC ..... 315/250, 294, 122, 185 R, 200 R, 291, 315/224, 307–308, 297, 192–193, 210, 315/302, 299
See application file for complete search history.

(56) References Cited

U.S. PATENT DOCUMENTS 7,978,171 B2 * 7/2011 Wu ..... H05B 33/0815 315/291
8,384,311 B2 2/2013 Gray et al.
8,901,849 B2 * 12/2014 Jeong ..... H05B 33/083 315/122
2008/0094000 A1 * 4/2008 Yamamoto ..... H05B 33/0803 315/250
2011/0084619 A1 * 4/2011 Gray ..... H05B 33/0824 315/185 R
2011/0234110 A1 * 9/2011 Liu ..... H05B 33/0818 315/186
2013/0169160 A1 * 7/2013 Kim ..... H05B 37/02 315/122
2014/0062317 A1 * 3/2014 Lee ..... H05B 33/083 315/185 R
2014/0184078 A1 * 7/2014 Hwang ..... H05B 33/083 315/122
2014/0210363 A1 7/2014 Lynch et al.
2014/0239824 A1 * 8/2014 Li ..... H05B 33/0812 315/185 R
2014/0306614 A1 * 10/2014 Pan ..... H05B 33/0824 315/193

(Continued)

FOREIGN PATENT DOCUMENTS

KR 10-1299360 8/2013
KR 10-2014-0054872 5/2014

*Primary Examiner* — Douglas W Owens
*Assistant Examiner* — Wei Chan
(74) *Attorney, Agent, or Firm* — Kile Park Reed & Houtteman PLLC

(57) ABSTRACT

Disclosed is a lighting apparatus for reducing total harmonic distortion (THD). The lighting apparatus may include a lighting unit having a plurality of LED groups divided into first and second lighting groups, and the lighting unit may provide a current path for light emission corresponding to a change of a rectified voltage, using two or more drives having the same structure.

16 Claims, 9 Drawing Sheets

(56) References Cited

U.S. PATENT DOCUMENTS

| | | | | |
|---|---|---|---|---|
| 2015/0115819 | A1* | 4/2015 | Park | H05B 33/0815 315/193 |
| 2015/0289341 | A1* | 10/2015 | Hong | H05B 33/0812 315/122 |

* cited by examiner

LIGHTING APPARATUS

BACKGROUND

1. Technical Field

The present disclosure relates to a lighting apparatus using an LED, and more particularly, to a lighting apparatus capable of reducing total harmonic distortion (THD).

2. Related Art

A lighting apparatus is designed to use a light source which exhibits high light emission efficiency using a small amount of energy, in order to reduce energy consumption. Representative examples of a light source used in the lighting apparatus may include an LED.

The LED is differentiated from other light sources in terms of various aspects such as energy consumption, lifetime, and light quality. However, since the LED is driven by a current, a lighting apparatus using the LED as a light source requires a large number of additional circuits for driving a current.

In order to solve the above-described problem, an AC direct-type lighting apparatus has been developed. The lighting apparatus is configured to convert an AC voltage into a rectified voltage, and drive a current using the rectified voltage such the LED emits light. The rectified voltage indicates a voltage obtained by full-wave rectifying an AC voltage. Since the lighting apparatus directly uses a rectified voltage without using an inductor and a capacitor, the lighting apparatus has a satisfactory power factor.

The lighting apparatus using an LED includes a driver which provides a current path in response to light emission following a change of the rectified voltage, and performs current regulation. The driver may be implemented with one chip including transistors such as FETs for providing a current path and performing current regulation.

The driver of the lighting apparatus using an LED emits light in response to a change of the rectified voltage, and nonlinearly controls a current for light emission.

However, the lighting apparatus using an LED has a problem that THD is high due to the nonlinear change of the current. Therefore, the lighting apparatus using an LED needs to improve power efficiency by reducing the THD.

SUMMARY

Various embodiments are directed to a lighting apparatus capable of buffering a nonlinear change of a current for light emission of a lighting unit including LEDs in response to a change of a rectified voltage, thereby reducing THD.

Also, various embodiments are directed to a lighting apparatus capable of increasing the number of light emission steps of a lighting unit and the number of change steps of a current by providing a current path corresponding to light emission of the lighting unit using two or more drivers, and reducing THD by buffering a nonlinear change of the current by the increase in the number of change steps of the current.

Also, various embodiments are directed to a lighting apparatus capable of providing a current path corresponding to light emissions of a plurality of LED groups using two or more drivers, thereby distributing heat generated by the light emissions to two or more drivers and reducing heat generation of each driver.

Also, various embodiments are directed to a lighting apparatus capable of avoiding the design of dedicated drivers corresponding to the increased number of LED groups and actively dealing with the increase in number of LED groups using two or more drivers having the same structure, when a lighting unit is divided into LED groups of which the number exceeds a predefined range which can be covered by one driver.

Also, various embodiments are directed to a lighting apparatus capable of dividing a plurality of drivers having the same structure into drivers corresponding to a small current, a medium current, and a large current, and associating the drivers with a plurality of LED groups, thereby reducing THD and heat generation of the drivers.

In an embodiment, a lighting apparatus may include: a lighting unit including LEDs divided into a plurality of LED groups connected in series, the plurality of LED groups being divided into first and second lighting groups, and configured to emit light using a rectified voltage; a first driver configured to provide a first current path corresponding to a change of the rectified voltage to each of the LED groups included in the first lighting group; a first sensing resistor connected to the first current path; a second driver configured to provide a second current path corresponding to a change of the rectified voltage to each of the LED groups included in the second lighting group; and a second sensing resistor connected between the second current path and the first sensing resistor.

In another embodiment, a lighting apparatus may include: a lighting unit including LEDs divided into a plurality of LED groups, the plurality of LED groups being divided into a plurality of LED groups, and configured to emit light using a rectified voltage; a plurality of drivers included in the respective lighting groups; and a sensing resistor circuit including a plurality of sensing resistors of which one ends are connected to the plurality of drivers, the sensing resistors being connected in series to each other. Each of the drivers may regulate a current flow between the LED groups included in the lighting group thereof and the sensing resistor connected thereto, using a sensing voltage of the sensing resistor connected thereto, in response to light emitting states of the plurality of LED groups corresponding to a change of the rectified voltage, and any one of the drivers may provide the current path corresponding to the light emitting states of the plurality of LED groups.

In another embodiment, a lighting apparatus may include: a lighting unit including LEDs divided into a plurality of LED groups, the plurality of LED groups being divided into first and second lighting groups, and configured to emit light using a rectified voltage; a first driver configured to provide a first current path corresponding to a change of the rectified voltage to each of the LED groups included in the first lighting group; a first sensing resistor connected to the first current path; a second driver configured to provide a second current path corresponding to a change of the rectified voltage to each of the LED groups included in the second lighting group; a second sensing resistor connected to the second current path; and a current control circuit configured to regulate a current flowing through the first sensing resistor in response to the amount of current flowing through the second sensing resistor.

In another embodiment, a lighting apparatus may include: a lighting unit including LEDs divided into a plurality of LED groups, the plurality of LED groups being divided into first and second lighting groups, and configured to emit light using a rectified voltage; a first driver configured to provide a first current path corresponding to a change of the rectified voltage to each of the LED groups included in the first lighting group; and a second driver configured to provide a second current path corresponding to a change of the rectified voltage to each of the LED groups included in the second lighting group. The second driver may provide the second current path in response to the rectified voltage equal to or more than the level at which the entire LED groups included in the first lighting group are controlled to emit light.

The first and second drivers may be connected to first and second sensing resistors, respectively, and the first sensing resistor may have a higher resistance value than the second sensing resistor.

The first and second drivers may share one sensing resistor, and the second driver may use reference voltages higher than the first driver.

DETAILED DESCRIPTION

Figure 1:
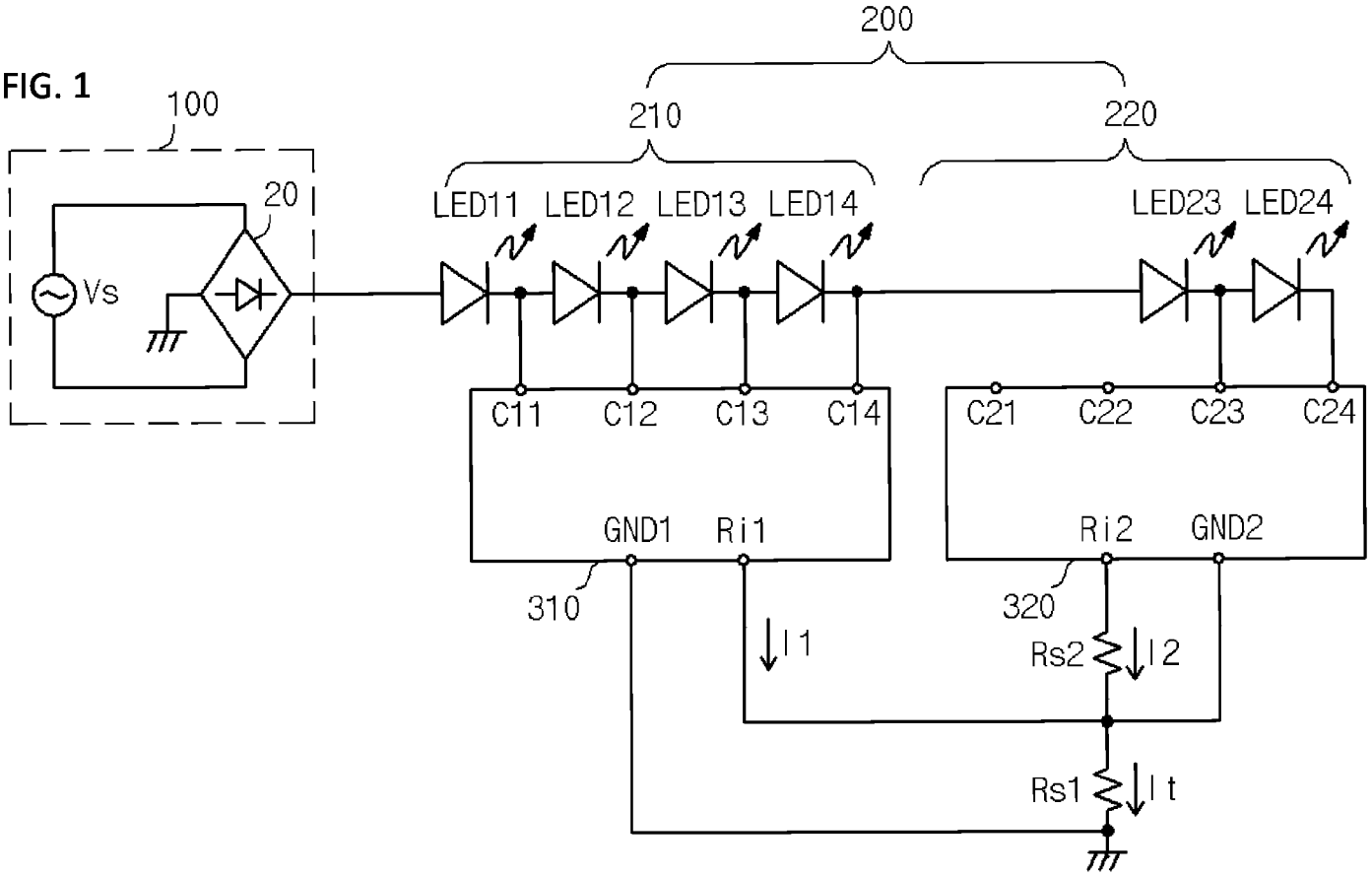
FIG. 1 is a circuit diagram illustrating a lighting apparatus in accordance with an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

A lighting apparatus in accordance with an embodiment of the present invention may use a light source including the light emitting characteristic of a semiconductor which converts electrical energy into light energy, and the light source including the light emitting characteristic may include an LED.

The lighting apparatus in accordance of the embodiment of the present invention may include an AC direct-type lighting apparatus. In the lighting apparatus of FIG. 1, a lighting unit including LEDs emits light using an AC voltage, and current regulation is performed to regulate a current in response to the light emission of the lighting unit.

This configuration will be described with reference to FIG. 1.

The lighting apparatus in accordance with the embodiment of the present invention may include a power supply unit 100, a lighting unit 200, drivers 310 and 320, and sensing resistors Rs1 and Rs2.

The power supply unit 100 provides a rectified voltage Vrec, the lighting unit 200 emits light using the rectified voltage Vrec, and the drivers 310 and 320 perform current regulation for regulating a current corresponding to the light emission of the lighting unit 200, and provide a current path for the light emission.

The power supply unit 100 includes a power supply Vs and a rectifier circuit 20. The power supply Vs may include a commercial AC power supply to provide AC power.

The rectifier circuit 20 is configured to convert a negative AC voltage into a positive voltage. That is, the rectifier circuit 20 full-wave rectifies a sine-wave AC voltage provided from the power supply Vs, and outputs the rectified voltage Vrec. The rectified voltage Vrec has a ripple in which the voltage level thereof rises or falls on a basis of the half cycle of the commercial AC voltage. In the embodiment of the present invention, the rise or fall of the rectified voltage Vrec may indicate a rise or fall of the ripple.

In the embodiment of the present invention, the lighting unit 200 including light sources emits light using the rectified voltage Vrec provided from the rectifier circuit 12.

The lighting unit 200 may include a plurality of LEDs, and the plurality of LEDs may be divided into a plurality of LED groups which are sequentially turned on or off according to changes of the rectified voltage Vrec. The plurality of LED groups included in the lighting unit 200 are connected in series.

The plurality of LED groups may be divided into first and second lighting groups 210 and 220. The first lighting group 210 includes LED groups LED11 to LED14 of which light emitting operations are controlled by the driver 310, and the second lighting group 220 includes LED groups LED23 and LED24 of which light emitting operations are controlled by the driver 320. In FIG. 1, the lighting unit 200 is divided into six LED groups LED11 to LED14 and LED 23 and LED24. The total number of LED groups and the number of LED groups included in each lighting group are only examples, and may be set to various values according to a designer's intention. Each of the LED groups LED11 to LED14 and LED23 and LED24 may include one or more LEDs connected in series, parallel, or serial-parallel to each other. For convenience of description, the one or more LEDs may be represented by one diode symbol.

The driver 310 corresponds to the first lighting group 210, and the driver 320 corresponds to the second lighting group 220.

The driver 310 regulates a current, and induces a constant current flow in response to light emission of the first lighting group 210. For this operation, the driver 310 regulates a current for light emission of the LED groups LED11 to LED14, and provides a first current path for light emission.

The driver 320 regulates a current, and induces a constant current flow in response to light emission of the second lighting group 220. For this operation, the driver 320 regulates a current for light emission of the LED groups LED23 and LED24, and provides a second current path for light emission.

The current path corresponding to light emission is provided by any one of the drivers 310 and 320. That is, the first current path by the driver 310 or the second current path by the driver 320 may be provided in response to light emission of the lighting unit 200 including the first and second lighting groups 210 and 220.

The sensing resistor Rs1 is connected to the first current path of the driver 310, and the sensing resistor Rs2 is connected between the sensing resistor Rs1 and the second current path of the driver 320.

In the above-described configuration, the driver 310 shares a first ground voltage with the sensing resistor Rs1, and the driver 320 uses the voltage of the node between the sensing resistors Rs1 and Rs2 as a second ground voltage. The drivers 310 and 320 use the first and second ground voltages in order to generate internal reference voltages.

In the embodiment of FIG. 1, the LED groups LED11 to LED14 and LED23 and LED24 connected in series in the lighting unit 200 are sequentially turned on or off in response to rises or falls of the rectified voltage Vrec. The driver 310 provides the first current path corresponding to the light emission of the LED groups LED11 to LED14 of the first lighting group 210, and the driver 320 provides the second current path corresponding to the light emission of the LED groups LED23 and LED24 of the second lighting group 220.

Figure 2:
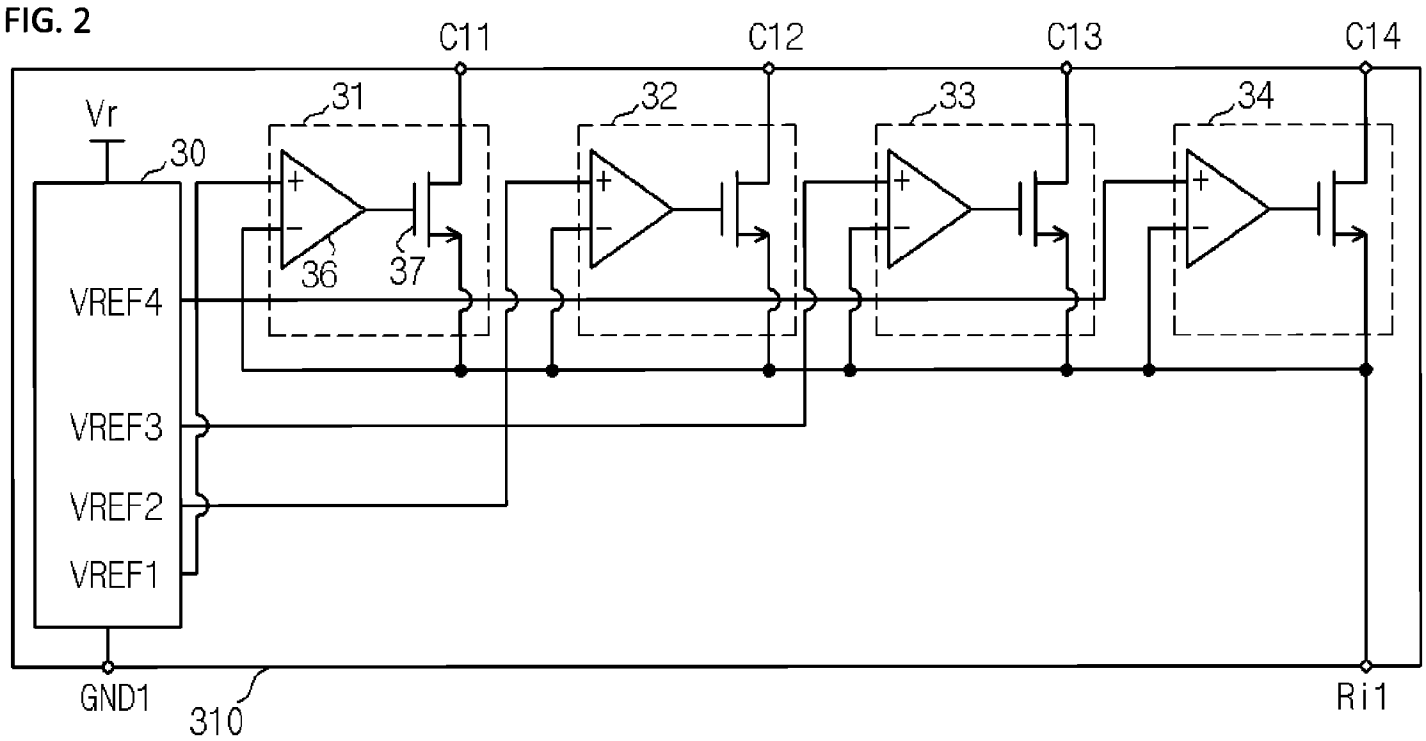
FIG. 2 is a detailed circuit diagram of a driver 310 of FIG. 1.
Figure 3:
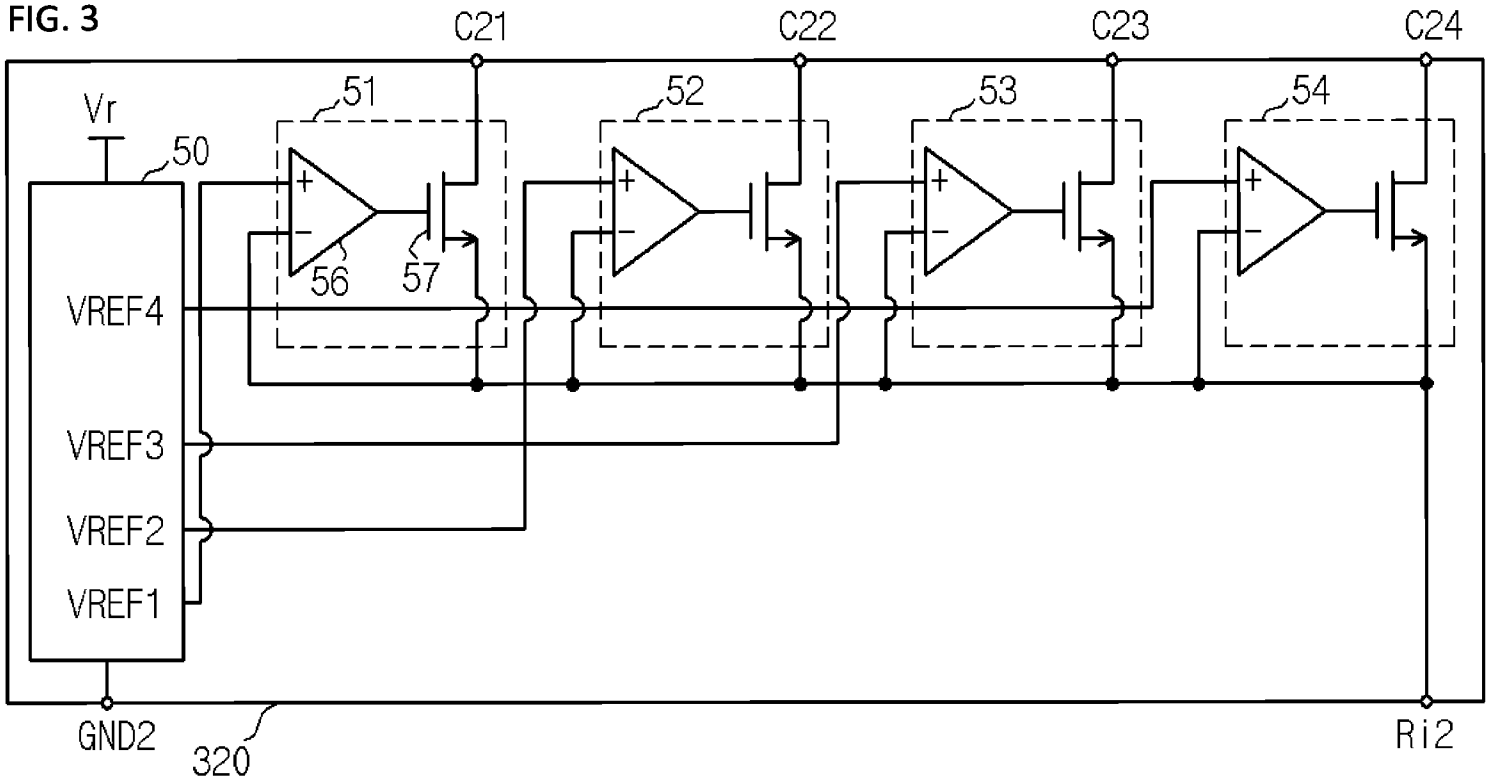
FIG. 3 is a detailed circuit diagram of a driver 320 of FIG. 1.

The driver 310 may be configured as illustrated in FIG. 2, and the driver 320 may be configured as illustrated in FIG. 3.

Referring to FIG. 2, the driver 310 has channels C11 to C14 connectable to the respective LED groups LED11 to LED14. The driver 310 provides the first current path for light emission, when the rectified voltage Vrec rises to sequentially reach the light emission voltages of the respective LED groups LED11 to LED14.

The light emission voltage V14 for controlling the LED group LED14 to emit light is defined as a voltage for controlling all of the LED groups LED11 to LED14 to emit light. The light emission voltage V13 for controlling the LED group LED13 to emit light is defined as a voltage for controlling the LED groups LED11 to LED13 to emit light. The light emission voltage V12 for controlling the LED group LED12 to emit light is defined as a voltage for controlling the LED groups LED11 and LED12 to emit light. The light emission voltage V11 for controlling the LED group LED11 to emit light is defined as a voltage for controlling only the LED group LED11 to emit light.

The driver 310 receives a sensing voltage through the sensing resistor Rs1. The sensing voltage may be varied as the position of the first current path within the driver 310 is changed, the position of the first current path being determined according to the light emitting states of the LED groups included in the first lighting group 210. At this time, the current flowing through the current sensing resistor Rs1 may be a constant current.

The driver 310 may include a reference voltage supply unit 30 and a plurality of switching circuits 31 to 34, which may be implemented as one chip. The reference voltage supply unit 30 may provide reference voltages VREF1 to VREF4, and the plurality of switching circuits 31 to 34 may perform a switching operation to provide the first current path for the LED groups LED11 to LED14. In FIGS. 1 and 2, Vr represents a constant voltage, GND1 represents a ground voltage terminal to which the first ground voltage shared by the sensing resistor Rs1 is applied, and Ri1 represents a sensing resistor terminal connected to the sensing resistor Rs1.

The reference voltage supply unit 30 may be configured to provide the reference voltages VREF1 to VREF4 having different levels according to a designer's intention.

The reference voltage supply unit 30 may include a plurality of resistors connected in series to each other, for example. The reference voltage supply unit 30 may divide a difference between the constant voltage Vr and the first ground voltage, and output the reference voltages VREF1 to VREF4 having different levels through nodes among the resistors. The first ground voltage may indicate the shared ground voltage of the sensing resistor Rs1. The reference voltage supply unit 30 may include independent voltage sources for providing the reference voltages VREF1 to VREF4 having different levels.

Among the reference voltages VREF1 to VREF4 having different levels, the reference voltage VREF1 may have the lowest voltage level, and the reference voltage VREF4 may have the highest voltage level. More specifically, the reference voltage VREF2 may be set to a higher level than the reference voltage VREF1, the reference voltage VREF3 may be set to a higher level than the reference voltage VREF2, and the reference voltage VREF4 may be set to a higher level than the reference voltage VREF3.

The reference voltage VREF1 has a level for turning off the switching circuit 31 at the point of time that the LED group LED12 emits light. More specifically, the reference voltage VREF1 may be set to a lower level than the sensing voltage which is formed in the sensing resistor Rs1 in response to light emission of the LED group LED12.

The reference voltage VREF2 has a level for turning off the switching circuit 32 at the point of time that the LED group LED13 emits light. More specifically, the reference voltage VREF2 may be set to a lower level than the sensing voltage which is formed in the sensing resistor Rs1 in response to light emission of the LED group LED13.

The reference voltage VREF3 has a level for turning off the switching circuit 33 at the point of time that the LED group LED14 emits light. More specifically, the reference voltage VREF3 may be set to a lower level than the sensing voltage which is formed in the sensing resistor Rs1 in response to light emission of the LED group LED14.

The reference voltage VREF4 has a level for turning off the switching circuit 34 at the point of time that the LED group LED23 emits light. More specifically, the reference voltage VREF4 may be set to a lower level than the sensing voltage which is formed in the sensing resistor Rs1 in response to light emission of the LED group LED23.

The switching circuits 31 to 34 are commonly connected to the sensing resistor Rs1 which provides a sensing voltage in order to perform current regulation and to form the first current path.

The switching circuits 31 to 34 compare the sensing voltage of the sensing resistor Rs1 to the reference voltages VREF1 to VREF4 of the reference voltage supply unit 30, and form a selective first current path corresponding to the light emitting state of the first lighting group 210.

The switching circuits 31 to 34 of the driver 310 induce a regulated constant current flow in response to light emissions of the respective LED groups LED11 to LED14, and perform current regulation in response to sequential light emissions of the respective LED groups LED11 to LED14 such that the constant current does not exceed a preset current value.

That is, each of the switching circuits 31 to 34 may not perform a current regulation operation on a current equal to or less than the regulated current value set thereto, but perform a current regulation operation on a current more than the regulated current value set thereto such that the current does not exceed the regulated level.

Each of the switching circuits 31 to 34 may include a comparator 36 and a switching element 37, and the switching element 37 may include an NMOS transistor.

The comparator 36 included in each of the switching circuits 31 to 34 has a positive input terminal (+) configured to receive a reference voltage, a negative input terminal (−) configured to receive a sensing voltage, and an output terminal configured to output a result obtained by comparing the reference voltage and the sensing voltage.

The NMOS transistor 37 included in each of the switching circuits 31 to 34 performs a switching operation according to the output of the comparator 36, which is applied through the gate thereof.

Referring to FIG. 3, the driver 310 has channels C21 to C24 connectable to the respective LED groups. The driver 320 provides the second current path for light emission, when the rectified voltage Vrec rises to sequentially reach the light emission voltages of the respective LED groups LED23 and LED24.

The light emission voltage V24 for controlling the LED group LED24 to emit light is defined as a voltage at which all of the LED groups LED11 to LED14 of the first lighting group 210 and the LED groups LED23 and 24 of the second lighting group 220 are controlled to emit light. The light emission voltage V23 for controlling the LED group LED23 to emit light is defined as a voltage at which the LED groups LED11 to LED14 of the first lighting group 210 and the LED group LED23 of the second lighting group 220 are controlled to emit light.

The driver 320 receives a sensing voltage through the sensing resistor Rs2. The sensing voltage may be varied as the position of the second current path within the driver 320 is changed, the position of the second current path being determined according to the light emitting states of the LED groups included in the second lighting group 220. At this time, the current flowing through the current sensing resistor Rs2 may be a constant current. The sensing voltage of the sensing resistor Rs2 may be set to equal to or higher than the sensing voltage of the sensing resistor Rs1.

The driver 320 may include a reference voltage supply unit 50 and a plurality of switching circuits 51 to 54, which can be implemented as one chip. The reference voltage supply unit 50 may provide the reference voltages VREF1 to VREF4, and the plurality of switching circuits 51 to 54 may provide a current path for the channels C21 to C24. In FIGS. 1 and 3, GND2 represents a ground voltage terminal to which the second ground voltage is applied, and Ri2 represents a sensing resistor terminal connected to the sensing resistor Rs2.

Since the reference voltage supply unit 50 has the same configuration as the reference voltage supply unit 30 of FIG. 2, the duplicated descriptions are omitted herein. The reference voltage supply unit 50 may divide a difference between the constant voltage Vr and the second ground voltage, and output the reference voltages VREF1 to VREF4 having different levels through nodes among the resistors. At this time, the voltage of the node between the sensing resistor Rs1 and the sensing resistor Rs2 may be used as the second ground voltage.

Since the switching circuits 51 to 54, the comparator 56, and the switching element 57 in FIG. 3 are configured in the same manner as the switching circuits 31 to 34, the comparator 36, and the switching element 37 in FIG. 2, the duplicated descriptions thereof are omitted herein. Among the switching circuits 51 to 54, the switching circuits 53 and 54 are connected to the LED groups LED23 and LDE24 included in the second lighting group 220 through the channels C23 and C24, respectively, and the channels C21 and C22 are opened.

The operation of the lighting apparatus configured as illustrated in FIGS. 1 to 3 will be described with reference to FIG. 4.

Figure 4:
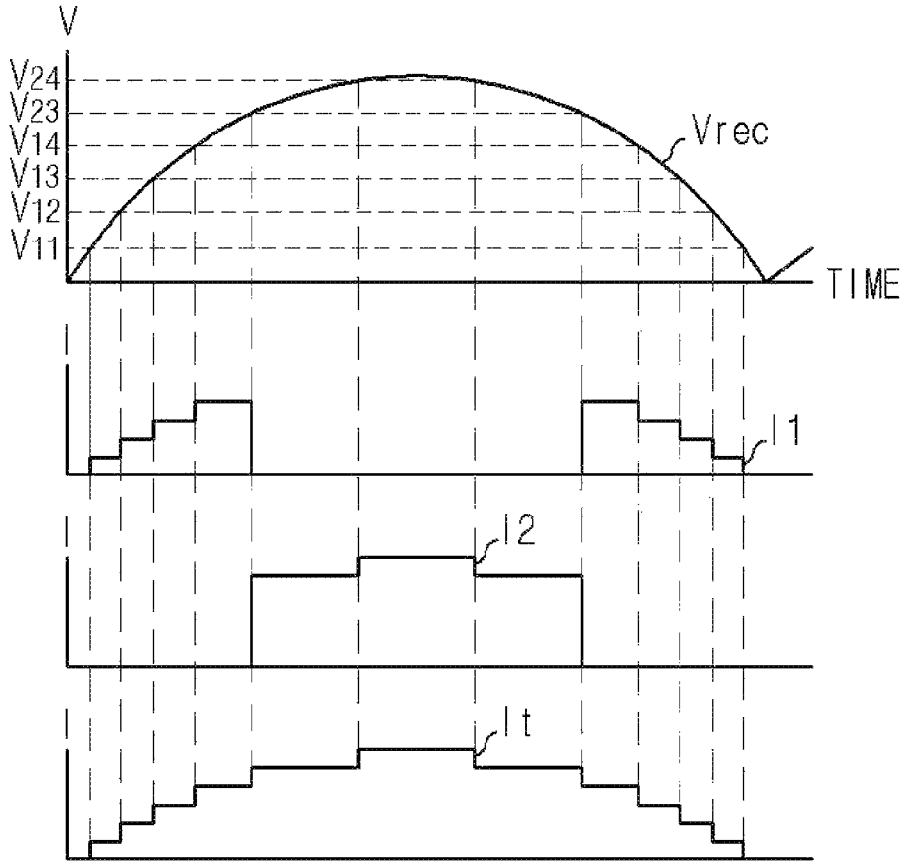
FIG. 4 is a waveform diagram for describing the operation of the lighting apparatus of FIG. 1.

The rectified voltage Vrec periodically rises and falls as illustrated in FIG. 4.

When the rectified voltage Vrec is in the initial state, the LED groups LED11 to LED14 of the first lighting group 210 and the LED groups LED23 and LED24 of the second lighting group 220 are turned off, and the switching circuits 31 to 34 of the driver 310 and the switching circuits 53 and 54 of the driver 320 are turned on, because the reference voltages VREF11 to VREF14 applied to the positive input terminals (+) thereof are higher than the sensing voltage of the sensing resistor Rs1 or Rs2, applied to the negative input terminals (−) thereof. At this time, a current flowing through the switching circuit 31 is equal to or less than the current value regulated by the switching circuit 31. Thus, the switching circuit 31 does not regulate the current flowing therein. That is, the current regulation operation by the switching circuit 31 is not performed.

Then, when the rectified voltage Vrec rises to reach the light emission voltage V11, the LED group LED11 of the first lighting group 210 emits light. Then, when the LED group LED11 emits light, the switching circuit 31 of the driver 310 connected to the LED group LED11 provides a current path used as the first current path.

When the rectified voltage Vrec reaches the light emission voltage V11 such that the LED group LED11 emits light and the current path is formed through the switching circuit 31, the level of the sensing voltage of the current sensing resistor Rs1 rises. However, since the level of the sensing voltage is low, the turn-on states of the switching circuits 31 to 34 of the driver 310 are not changed. Furthermore, the current flowing through the switching circuit 31 is regulated by the current regulation operation of the switching circuit 31.

Then, the rectified voltage Vrec may rise above the light emission voltage V11. At this time, a current flowing through the switching circuit 32 is equal to or less than the current value regulated by the switching circuit 32. Thus, the switching circuit 32 does not regulate the current flowing therein. That is, the current regulation operation by the switching circuit 31 is performed, but the current regulation operation by the switching circuit 32 is not performed.

Then, when the rectified voltage Vrec continuously rises to reach the light emission voltage V12, the LED group LED12 of the first lighting group 210 emits light. When the LED group LED12 emits light, the switching circuit 32 of the driver 310 connected to the LED group LED12 provides a current path used as the first current path. At this time, the LED group LED11 also maintains the light emitting state.

When the rectified voltage Vrec reaches the light emission voltage V12 such that the LED group LED12 emits light and the current path is formed through the switching circuit 32, the level of the sensing voltage of the sensing resistor Rs1 rises. At this time, the sensing voltage has a higher level than the reference voltage VREF1. Therefore, the switching element 37 of the switching circuit 31 is turned off by an output of the comparator 36. That is, the switching circuit 31 is turned off, and the switching circuit 32 provides a current path used as the first current path corresponding to the light emission of the LED group LED12. At this time, a current flowing through the switching circuit 32 is regulated by the current regulation operation of the switching circuit 32.

Then, when the rectified voltage Vrec continuously rises to reach the light emission voltage V13, the LED group LED13 of the first lighting group 210 emits light. When the LED group LED13 emits light, the switching circuit 33 of the driver 310 connected to the LED group LED13 provides a current path used as the first current path. At this time, the LED groups LED11 and LED12 also maintain the light emitting state.

When the rectified voltage Vrec reaches the light emission voltage V13 such that the LED group LED13 emits light and the current path is formed through the switching circuit 33, the level of the sensing voltage of the sensing resistor Rs1 rises. At this time, the sensing voltage has a higher level than the reference voltage VREF2. Therefore, the switching element 37 of the switching circuit 32 is turned off by an output of the comparator 36. That is, the switching circuit 32 is turned off, and the switching circuit 33 provides a current path used as the first current path corresponding to the light emission of the LED group LED13. At this time, a current flowing through the switching circuit 33 is regulated by the current regulation operation of the switching circuit 33.

Then, when the rectified voltage Vrec reaches the light emission voltage V14, the LED group LED14 of the first lighting group 210 emits light. When the LED group LED14 emits light, the switching circuit 34 of the driver 310 connected to the LED group LED14 provides a current path used as the first current path. At this time, the LED groups LED11 to LED13 also maintain the light emitting state.

When the rectified voltage Vrec reaches the light emission voltage V14 such that the LED group LED14 emits light and the current path is formed through the switching circuit 34, the level of the sensing voltage of the sensing resistor Rs1 rises. At this time, the sensing voltage has a higher level than the reference voltage VREF3. Therefore, the switching element 37 of the switching circuit 33 is turned off by an output of the comparator 36. That is, the switching circuit 33 is turned off, and the switching circuit 34 provides a current path used as the first current path corresponding to the light emission of the LED group LED14. At this time, a current flowing through the switching circuit 34 is regulated by the current regulation operation of the switching circuit 34.

Then, when the rectified voltage Vrec continuously rises to reach the light emission voltage V23, the LED group LED23 of the second lighting group 220 emits light. When the LED group LED23 emits light, the switching circuit 53 of the driver 320 connected to the LED group LED23 provides a current path used as the second current path. At this time, the LED groups LED11 to LED14 of the first lighting group 210 also maintain the light emitting state.

When the rectified voltage Vrec reaches the light emission voltage V23 such that the LED group LED23 emits light and the current path is formed through the switching circuit 53, the levels of the sensing voltages of the sensing resistors Rs1 and Rs2 rise. At this time, the sensing voltage of the sensing resistor Rs1 has a higher level than the reference voltage VREF4. Therefore, the switching element 37 of the driver 310 is turned off by an output of the comparator 36. That is, the switching circuit 34 is turned off, and the switching circuit 53 of the driver 320 provides a current path used as the second current path corresponding to light emission of the LED group LED23. At this time, a current flowing through the switching circuit 53 is regulated by the current regulation operation of the switching circuit 53.

Then, when the rectified voltage Vrec reaches the light emission voltage V24, the LED group LED24 of the second lighting group 220 emits light. When the LED group LED24 emits light, the switching circuit 54 of the driver 320 connected to the LED group LED24 provides a current path used as the second current path. At this time, the LED groups LED11 to LED14 of the first lighting group 210 and the LED group LED23 of the second lighting group 220 also maintain the light emitting state.

When the rectified voltage Vrec reaches the light emission voltage V24 such that the LED group LED24 emits light and the current path is formed through the switching circuit 54, the level of the sensing voltage of the sensing resistor Rs2 rises. At this time, the sensing voltage of the sensing resistor Rs2 has a higher level than the reference voltage VREF3. Therefore, the switching element 57 of the switching circuit 53 is turned off by an output of the comparator 56. That is, the switching circuit 53 is turned off, and the switching circuit 54 provides a current path used as the second current path corresponding to the light emission of the LED group LED24. At this time, a current flowing through the switching circuit 54 is regulated by the current regulation operation of the switching circuit 54.

Then, the rectified voltage may rise above the light emission voltage V24. At this time, the switching circuit 54 may regulate the flowing current in response to the current level. Then, although the rectified voltage Vrec continuously rises, the switching circuit 54 maintains the turn-on state such that the current formed in the sensing resistor Rs2 becomes a predetermined constant current in the upper limit level region of the rectified voltage Vrec.

As described above, when the LED groups LED11 to LED14 of the first lighting group 210 and the LED groups LED23 and LED24 of the second lighting group 220 sequentially emit light in response to the rises of the rectified voltage Vrec, the current I1 on the first current path of the driver 310 increases in a stepwise manner until the rectified voltage Vrec reaches the light emission voltage V23, and does not flow while the rectified voltage Vrec is maintained at more than the light emission voltage V23. The current I2 on the second current path of the driver 320 increases in a stepwise manner while the rectified voltage Vrec is maintained at more than the light emission voltage V23. As a result, a current corresponding to the sum of the current I1 on the first current path and the current I2 on the second current path is passed to the sensing resistor Rs1. The current It flowing through the sensing resistor Rs1 has a waveform which increases in a stepwise manner while the rectified voltage Vrec is changed.

After rising to the predetermined upper limit level, the rectified voltage Vrec starts to fall. When the rectified voltage Vrec falls below the light emission voltage V24, the LED group LED24 of the second lighting group 220 is turned off. When the LED group LED24 of the second lighting group 220 is turned off, the second current path is formed by the switching circuit 53. At this time, the LED groups LED11 to LED14 of the first lighting group 210 and the LED group LED23 of the second lighting group 220 maintain the light emitting state.

Then, when the rectified voltage Vrec sequentially falls below the light emission voltages V23, V14, V13, V12, and V11, the LED group LED23 of the second lighting group 220 and the LED groups LED14 to LED11 of the first lighting group 210 are sequentially turned off.

As the LED group LED23 of the second lighting group 220 and the LED groups LED14 to LED11 of the first lighting group 210 are sequentially turned off, the sensing voltages of the sensing resistors Rs2 and Rs1 are lowered, and the current path is shifted from the second current path to the first current path. Furthermore, the first current path is also shifted in response to the turn-off states of the LED groups LED11 to LED14, and the current It flowing through the sensing resistor Rs1 has a waveform which decreases in a stepwise manner while the rectified voltage Vrec is changed.

According to the above-described configuration, as two drivers for the same rectified voltage Vrec are used to drive six channels, a nonlinear change of the current can be buffered to reduce total harmonic distortion (THD), compared to when one driver is used to drive four channels.

Furthermore, a channel through which a small current flows and a channel through which a medium or large current flows may be implemented with different drivers, which makes it possible to reduce heat generation of the drivers through light emission.

Furthermore, two drivers having the same structure may be used to implement a driving circuit corresponding to LED channels of which the number exceeds a predefined range which can be covered by one driver. For example, when a four-channel driver is designed, a six-channel or eight-channel driver does not need to be separately developed according to a lighting apparatus which emits light through six or eight channels, but two four-channel drivers can be used to actively deal with the expanded channels.

Figure 5:
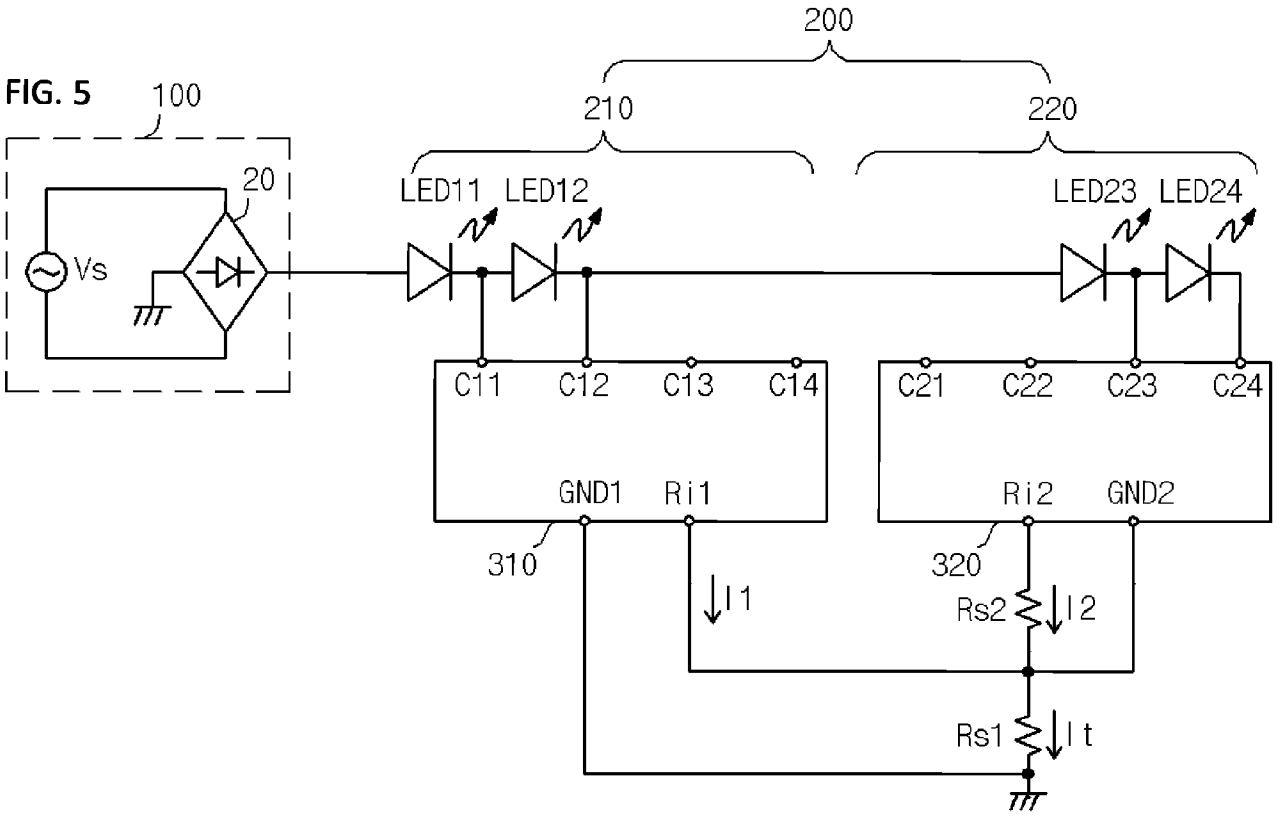
FIG. 5 is a circuit diagram illustrating a lighting apparatus in accordance with another embodiment of the present invention.

Furthermore, even when the lighting apparatus in accordance with the embodiment of the present invention includes channels of which the number falls within a predefined range which can be covered by one driver as illustrated in FIG. 5, a channel through which a small current flows and a channel through which a medium or large current flows can be implemented with different drivers.

Since the components of FIG. 5 are configured in the same manner as those of FIGS. 1 and 3, the duplicated descriptions thereof are omitted.

Furthermore, three or more drivers having the same structure, which include an equal number of channels connectable to an LED group, may be used to implement the lighting apparatus.

In this case, the lighting unit may include LEDs divided into a plurality of LED groups which are divided into a plurality of lighting groups, and emit light using a rectified voltage. The plurality of drivers may be provided in the respective lighting groups. Furthermore, a sensing resistor circuit may include a plurality of sensing resistors of which one ends are connected to the respective drivers, and the sensing resistors may be connected in series.

At this time, each of the drivers selectively provides a current path corresponding to the light emitting states of the plurality of LED groups, in response to a change of the rectified voltage. More specifically, each of the drivers may regulate a current flow between the LED groups included in the corresponding lighting group and the sensing resistor connected to the driver, using the sensing voltage of the sensing resistor connected to the driver, thereby selectively providing a current path corresponding to the light emitting states of the plurality of LED groups.

An embodiment for this configuration may be described with reference to FIG. 6.

Figure 6:
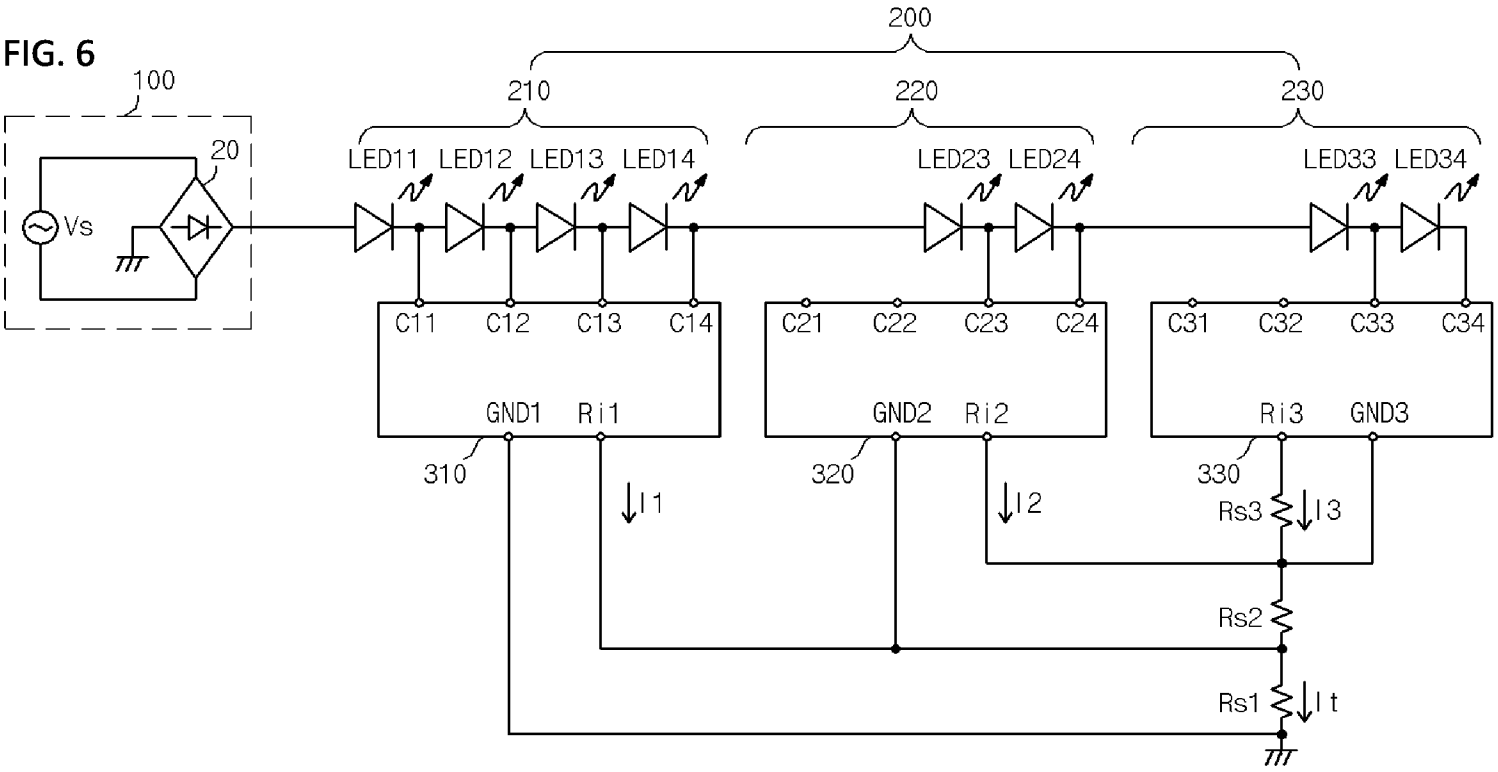
FIG. 6 is a circuit diagram illustrating a lighting apparatus in accordance with another embodiment of the present invention.

FIG. 6 illustrates a driving circuit corresponding to LED channels of which the number exceeds a predefined range which can be covered by one driver, using three drivers 310, 320, and 330 having the same structure. More specifically, when the lighting unit is configured to have eight channels, four channels may be configured to emit light using the first driver 310, two channels may be configured to emit light using the second driver 320, and two channels may be configured to emit light using the third driver 330.

In the embodiment of FIG. 6, sensing resistors Rs1 to Rs3 for providing sensing voltages and ground voltages to the three drivers 310 to 330, respectively, may be connected in series to each other. One ends of the sensing resistors may be connected to the respective drivers 310 to 330, and the other ends of the sensing resistors Rs1 to Rs3 may be connected to ground voltage terminals GND1 to GND3.

Since the drivers 310 to 330 of FIG. 6 are configured in substantially the same manner as those of FIGS. 1 and 3, the duplicated descriptions thereof are omitted herein.

Each of the drivers 310 to 330 is configured to compare the sensing voltage of the sensing resistor connected to the driver to reference voltages obtained by dividing a difference between an internal or external constant voltage and the ground voltage corresponding to the voltage of the other end of the sensing resistor corresponding to the lighting group thereof, and regulate a current flow between the sensing resistor connected to the driver and the LED groups included in the lighting group thereof.

Each of the drivers 310 to 330 may be configured to form the same reference voltages.

The sensing resistor circuit may include a plurality of sensing resistors Rs1 to Rs3 of which one ends are connected to the respective drivers 310 to 330. The sensing resistors Rs1 to Rs3 may provide a high sensing voltage to an LED group which emits light in response to a relatively high rectified voltage Vrec.

The lighting apparatus in accordance with the embodiment of FIG. 6 can also buffer a nonlinear change of the current and thus reduce THD. Furthermore, a channel through which a small current flows and a channel through which a medium or large current flows can be implemented with different drivers.

Figure 7:
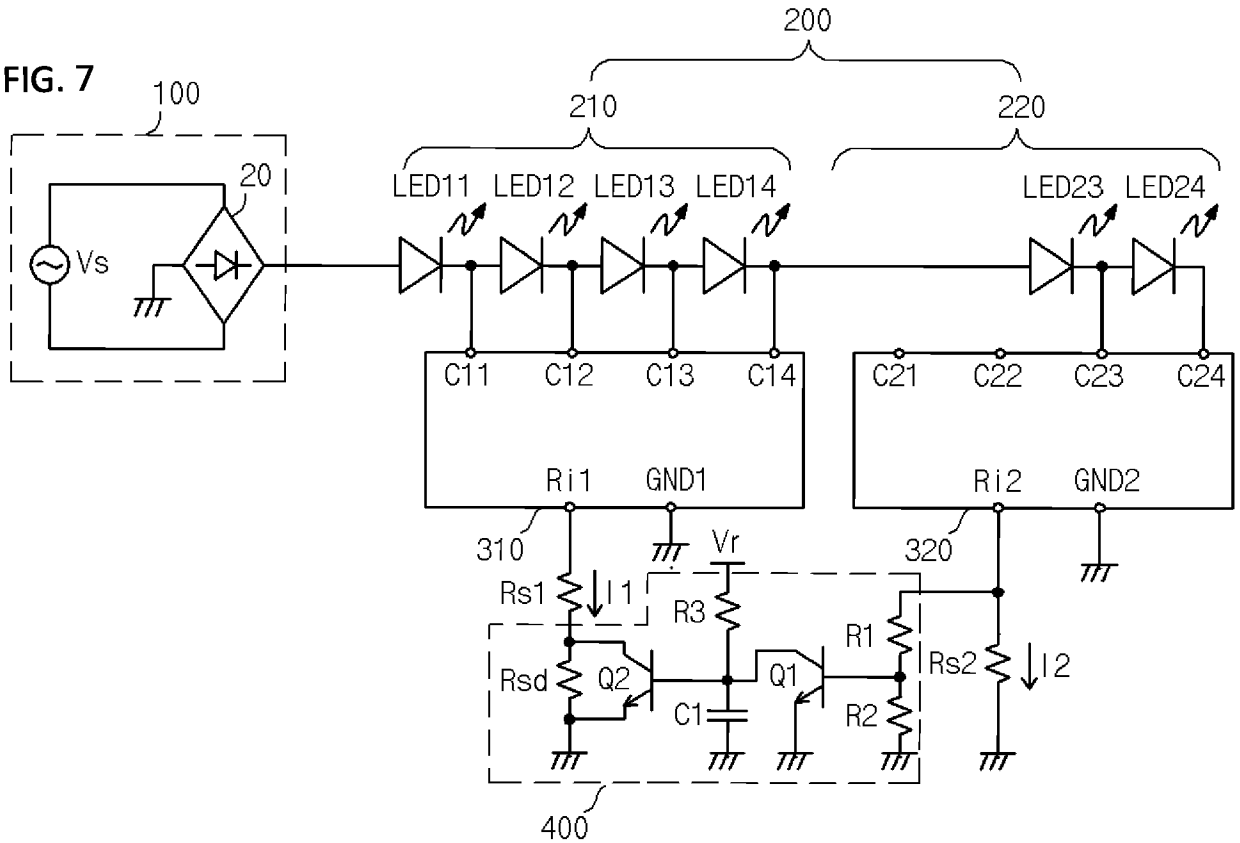
FIG. 7 is a circuit diagram illustrating a lighting apparatus in accordance with another embodiment of the present invention.

The lighting apparatus in accordance with the embodiment of the present invention may be configured as illustrated in FIG. 7. Referring to FIG. 7, the lighting apparatus may include a lighting unit 200, a sensing resistor Rs1, a driver 310, a sensing resistor Rs2, a driver 320, and a current control circuit 400.

In the embodiment of FIG. 7, the lighting unit 200 may include LEDs divided into a plurality of LED groups, the plurality of LED groups being divided into first and second lighting groups 210 and 220, and emit light using a rectified voltage Vrec.

The driver 310 is configured to provide a first current path corresponding to a change of the rectified voltage Vrec to each of the LED groups included in the first lighting group 210. The sensing resistor Rs1 is connected to the first current path.

The driver 320 is configure to provide a second current path corresponding to a change of the rectified voltage Vrec to each of the LED groups included in the second lighting group 220. The sensing resistor Rs2 is connected to the second current path.

The current control circuit 400 is configured to regulate a current flowing through the sensing resistor Rs1 in response to the amount of current which flows through the sensing resistor Rs2 as the second lighting group 220 emits light. For this operation, the current control circuit 400 may include a dummy resistor Rsd connected in series to the sensing resistor Rs1.

The current control circuit 400 may include first and second control circuits.

The first control circuit may be configured to generate a switching voltage which is changed on the basis of a constant voltage Vr, in response to the amount of current flowing through the sensing resistor Rs2. For this operation, the first control circuit may include resistors R1 and R2 connected in series to sense the current of the sensing resistor Rs2, a resistor R3 and a capacitor C1 connected in series between the constant voltage Vr and the ground, and a transistor Q1 configured to control the potential between the resistor R3 and the capacitor C1 according to the node voltages of the resistors R1 and R2, applied to the base thereof. The operation of the transistor Q1 can generate the switching voltage which is changed on the basis of the constant voltage Vr. At this time, an internal constant voltage of the driver 310 or 320 or a separate constant voltage may be used as the constant voltage Vr. When the internal constant voltage of the driver 310 or 320 is used, the constant voltage Vr may be used to generate reference voltages in the driver 310 or 320. The switching voltage may be defined as a voltage applied to the node between the resistor R3 and the capacitor C1.

The second control circuit may include a transistor Q2 which controls a current flowing through the sensing resistor Rs1 in response to a change of the switching voltage.

The lighting apparatus in accordance with the embodiment of FIG. 7 can also buffer a nonlinear change of the current and thus reduce THD. Furthermore, a channel through which a small current flows and a channel through which a medium or large current flows can be implemented with different drivers.

Figure 8:
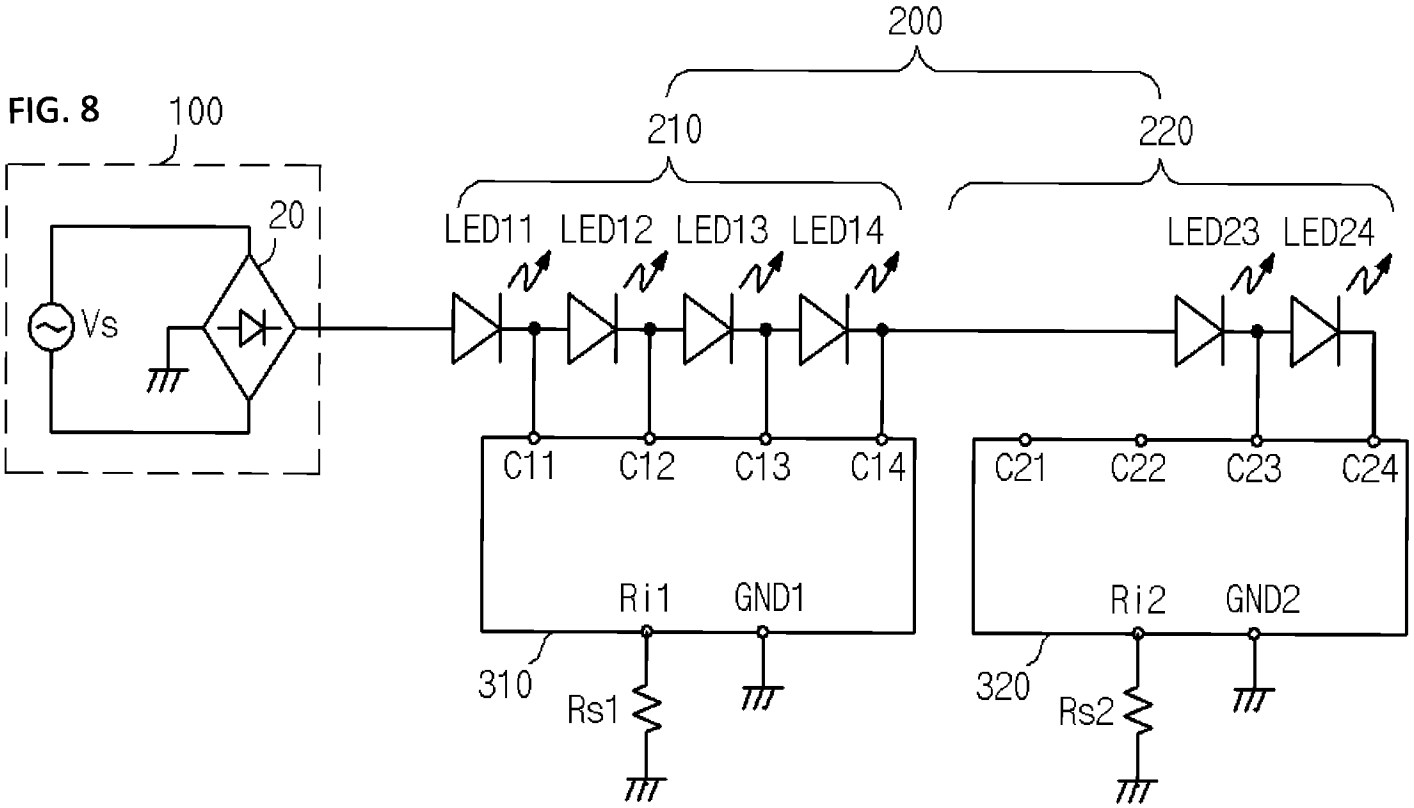
FIG. 8 is a circuit diagram illustrating a lighting apparatus in accordance with another embodiment of the present invention.

When the lighting unit 200 includes LEDs divided into a plurality of LED groups connected in series and the plurality of LED groups are divided into first and second lighting groups 210 and 220, the lighting apparatus in accordance with the embodiment of the present invention may be configured as illustrated in FIG. 8.

Referring to FIG. 8, the lighting apparatus in accordance with the embodiment of the present invention may include drivers 310 and 320. The driver 310 may provide a first current path corresponding to a change of the rectified voltage Vrec to each of the LED groups included in the first lighting group 210, and the driver 320 may provide a second current path corresponding to a change of the rectified voltage Vrec to each of the LED groups included in the second lighting group 220.

The driver 320 may be configured to provide the second current path in response to the rectified voltage Vrec equal to or more than the level at which the entire LED groups included in the first lighting group 210 are controlled to emit light.

For this operation, the drivers 310 and 320 may be connected to different sensing resistors, that is, sensing resistors Rs1 and Rs2, and provide the first and second current paths, respectively.

In this case, the reference voltages of the drivers 310 and 320 may have the same level, and the sensing resistor Rs1 may be set to have a higher resistance value than the sensing resistor Rs2.

Figure 9:
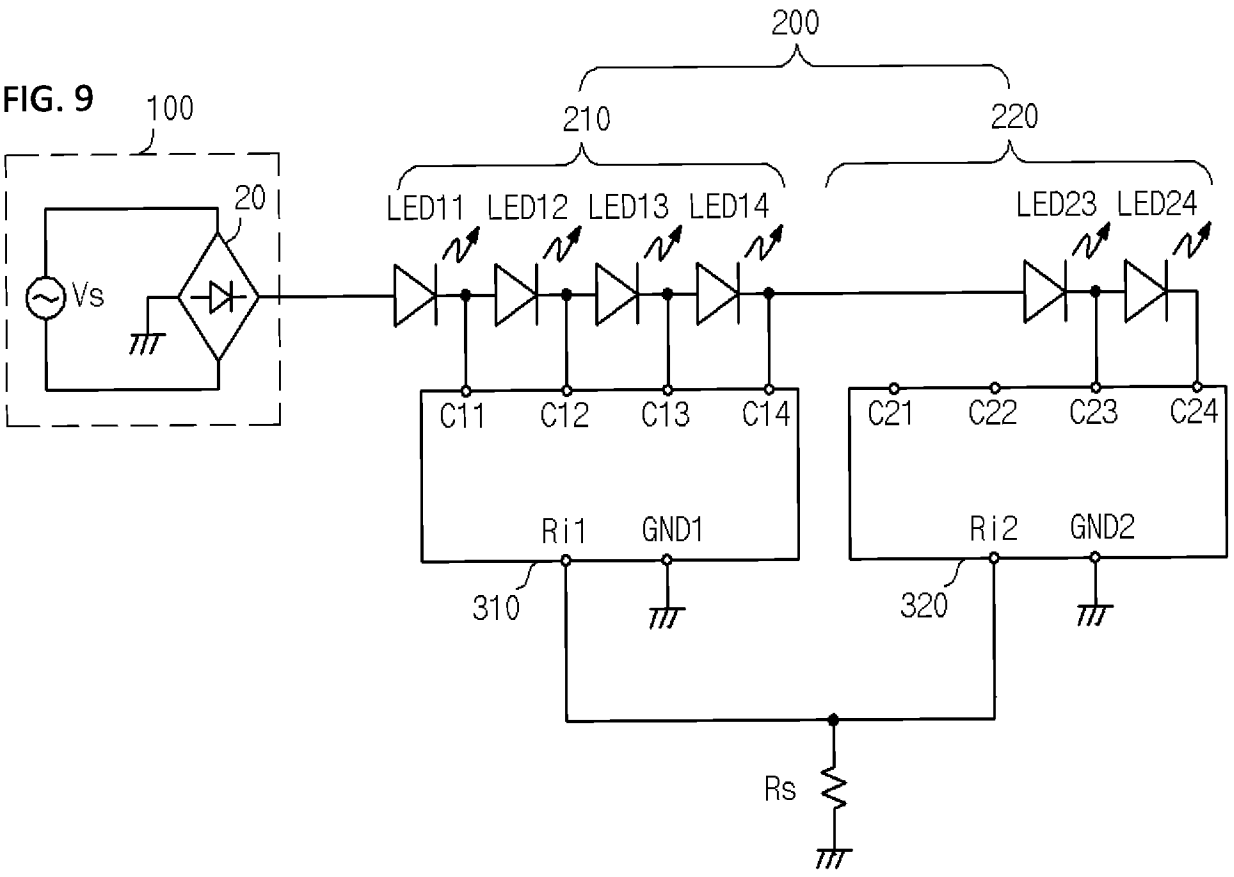
FIG. 9 is a circuit diagram illustrating a lighting apparatus in accordance with another embodiment of the present invention.

The lighting apparatus in accordance with the embodiment of the present invention may be configured as illustrated in FIG. 9. Referring to FIG. 9, the lighting unit may provide a current path to a lighting unit 200 which includes the LEDs divided into a plurality of LED groups connected in series, the plurality of LED groups being divided into first and second lighting groups 210 and 220.

Referring to FIG. 9, the lighting apparatus in accordance with the embodiment of the present invention may include drivers 310 and 320. The driver 310 may provide a first current path corresponding to a change of a rectified voltage Vrec to each of LED groups included in the first lighting group 210, and the driver 320 may provide a second current path corresponding to a change of the rectified voltage Vrec to each of LED groups included in the second lighting group 220.

The drivers 310 and 320 may share one sensing resistor Rs, and the driver 320 may be configured to provide the second current path in response to the rectified voltage Vrec equal to or higher than the level at which the entire LED groups included in the first lighting group 210 are controlled to emit light.

For this operation, the driver 320 may be set to have a second reference voltage higher than the first reference voltages of the driver 310.

In accordance with the embodiments of the present invention, the lighting apparatus may increase the number of nonlinear change steps of a current in response to the changes of the rectified voltage, and buffer nonlinear changes of the current at the respective change steps. Thus, THD of the lighting apparatus including LEDs can be reduced.

Furthermore, the lighting apparatus can provide a current path corresponding to light emissions of the plurality of LED groups using two or more drivers and increase the number of nonlinear change periods of a current. Thus, the lighting apparatus can buffer nonlinear changes of the current and reduce THD.

Furthermore, the lighting apparatus can provide a current path corresponding to light emissions of the plurality of LED channels using two or more drivers, thereby reducing heat generation of the drivers corresponding to the light emissions.

Furthermore, when the lighting unit is divided into LED channels of which the number exceeds a predefined range which can be covered by one driver, the lighting apparatus may avoid the design of dedicated drivers corresponding to the number of LED channels, and actively deal with the increase in number of LED channels using drivers having the same structure.

Furthermore, as the drivers having the same structure are divided into drivers corresponding to a small current, a medium current, and a large current and associated with the plurality of LED groups, the lighting apparatus can reduce heat generation of the drivers while reducing THD.

While various embodiments have been described above, it will be understood to those skilled in the art that the embodiments described are by way of example only. Accordingly, the disclosure described herein should not be limited based on the described embodiments.

What is claimed is:

1. A lighting apparatus comprising:

a lighting unit comprising LEDs divided into a plurality of LED groups connected in series, the plurality of LED groups being divided into a first lighting group and a second lighting group, and configured to emit light using a rectified voltage;

a first driver configured to provide a first current path corresponding to a change of the rectified voltage to each of the LED groups included in the first lighting group;

a first sensing resistor connected to the first current path;

a second driver configured to provide a second current path corresponding to a change of the rectified voltage to each of the LED groups included in the second lighting group; and a second sensing resistor connected between the second current path and the first sensing resistor, wherein the first driver compares first reference voltages obtained by dividing a difference between a constant voltage and a first ground voltage to a first sensing voltage applied to the first sensing resistor, and regulates a current flow between the first sensing resistor and the LED groups included in the first lighting group, in order to provide the first current path, and the second driver compares second reference voltage obtained bv dividing a difference between the constant voltage and a second ground voltage to a second sensing voltage applied to the second sensing resistor, and regulates a current flow between the second sensing resistor and the LED groups included in the second lighting group, in order to provide the second current path.

2. The lighting apparatus of claim 1, wherein the first driver shares the first ground voltage with the first sensing resistor, and the second driver uses a voltage of a node between the first sensing resistor and the second sensing resistor as the second ground voltage.

3. The lighting apparatus of claim 2, wherein the first driver and the second driver are configured to form the first reference voltages and the second reference voltages such that the first reference voltages have the same levels as the second reference voltages.

4. The lighting apparatus of claim 2, wherein the first driver comprises:

a first reference voltage supply unit configured to provide the first reference voltages by dividing the difference between the constant voltage and the first ground voltage; and two or more first switching circuits each configured to compare the first sensing voltage to the first reference voltage corresponding to the LED group connected thereto, regulate the current flow between the first sensing resistor and the LED group connected thereto, and selectively provide the first current path, and the second driver comprises:

a second reference voltage supply unit configured to provide the second reference voltages by dividing the difference between the constant voltage and the second ground voltage; and two or more second switching circuits each configured to compare the second sensing voltage to the second reference voltage corresponding to the LED group connected thereto, regulate the current flow between the second sensing resistor and the LED group connected thereto, and selectively provide the second current path.

5. The lighting apparatus of claim 1, wherein the first driver and the second driver has an equal number of channels connectable to the plurality of LED groups.

6. The lighting apparatus of claim 1, wherein the resistance values of the first sensing resistor and the second sensing resistor are set to guarantee that a minimum current amount of the second current path is equal to or more than a maximum current amount of the first current path.

7. A lighting apparatus comprising:

a lighting unit comprising LEDs divided into a plurality of LED groups, the plurality of LED groups being divided into a plurality of LED groups, and configured to emit light using a rectified voltage;

a plurality of drivers included in respective lighting groups; and a sensing resistor circuit comprising a plurality of sensing resistors of which one ends are connected to the plurality of drivers, the sensing resistors being connected in series to each other, wherein each of the drivers regulates a current flow between the LED groups included in the lighting group thereof and the sensing resistor connected thereto, using a sensing voltage of the sensing resistor connected thereto, in response to light emitting states of the plurality of LED groups corresponding to a change of the rectified voltage, and any one of the drivers provides a current path corresponding to the light emitting states of the plurality of LED groups, wherein each of the drivers compares reference voltages obtained by dividing a difference between a constant voltage and a ground voltage thereof to the sensing voltage of the sensing resistor connected thereto, and regulates the current flow between the LED groups included in the lighting group thereof and the sensing resistor connected thereto.

8. The lighting apparatus of claim 7, wherein the plurality of drivers are configured in such a manner that a minimum current amount of a driver which provides the current path later in response to a rise of the rectified voltage is equal to or more than a maximum current amount of another driver which provides the current path earlier in response to the rise of the rectified voltage.

9. The lighting apparatus of claim 7, wherein the plurality of drivers are configured to form the reference voltages having the same levels.

10. The lighting apparatus of claim 8, wherein the driver comprises:

a reference voltage generation unit configured to provide the reference voltages by dividing the difference between the constant voltage and the ground voltage thereof; and two or more switching circuits configured to compare any one of the reference voltages to the sensing voltage of the sensing resistor corresponding to the lighting group thereof, and regulate the current flow between any one channel connectable to the LED group and the sensing resistor corresponding to the lighting group thereof.

11. The lighting apparatus of claim 8, wherein the plurality of drivers has an equal number of channels connectable to the LED group.

12. A lighting apparatus comprising:

a lighting unit comprising LEDs divided into a plurality of LED groups, the plurality of LED groups being divided into a first lighting group and a second lighting group, and configured to emit light using a rectified voltage;

a first driver configured to provide a first current path corresponding to a change of the rectified voltage to each of the LED groups included in the first lighting group;

a first sensing resistor connected to the first current path;

a second driver configured to provide a second current path corresponding to a change of the rectified voltage to each of the LED groups included in the second lighting group;

a second sensing resistor connected to the second current path; and a current control circuit configured to regulate a current flowing through the first sensing resistor in response to an amount of current flowing through the second sensing resistor.

13. The lighting apparatus of claim 12, wherein resistance values of the first sensing resistor and the second sensing resistor are set to guarantee that a maximum current amount of the second current path is equal to or more than a maximum current amount of the first current path.

14. The lighting apparatus of claim 12, wherein the first driver and the second driver provide the first current path and the second current path, respectively, using reference voltages having the same levels.

15. The lighting apparatus of claim 12, wherein the first driver and the second driver share one sensing resistor.

16. The lighting apparatus of claim 15, wherein the first driver compares first reference voltages to a sensing voltage of the sensing resistor and regulates a current flow between the sensing resistor and the LED groups included in the first lighting group, in order to provide the first current path, the second driver compares second reference voltages to the sensing voltage of the sensing resistor and regulates a current flow between the sensing resistor and the LED groups included in the second lighting group, in order to provide the second current path, and the first reference voltages and the second reference voltages are set to guarantee that a minimum current amount of the second current path is equal to or more than a maximum current amount of the first current path.

* * * * *